US005291705A

United States Patent [19]

Dickerson

[11] Patent Number: 5,291,705

[45] Date of Patent: Mar. 8, 1994

[54] ENCASED SKYLIGHT FRAMEWORK

[75] Inventor: Gary O. Dickerson, Mequon, Wis.

[73] Assignee: Super Sky Products, Inc., Mequon, Wis.

[21] Appl. No.: 886,121

[22] Filed: May 20, 1992

[51] Int. Cl.[5] ..... E04B 7/18

[52] U.S. Cl. ..... 52/200; 52/464; 52/730.1; 52/730.5; 52/732.1

[58] Field of Search ..... 52/200, 202, 208, 209, 52/464, 772, 468, 235, 730.1, 730.3, 730.4, 730.5, 730.6, 732.1, 732.2; 49/DIG. 2

[56] References Cited

U.S. PATENT DOCUMENTS

| | | | |
|---|---|---|---|
| 3,844,087 | 10/1974 | Schultz et al. | 52/200 |
| 4,015,390 | 4/1977 | Howorth | 52/235 |
| 4,117,640 | 10/1978 | Vanderstar | 52/730.3 |
| 4,455,798 | 6/1984 | Tsakiris | 52/200 |
| 4,506,484 | 3/1985 | Bartlett et al. | 52/476 |
| 4,543,755 | 10/1985 | Crandell | 52/235 |
| 4,683,693 | 8/1987 | Rockar et al. | 52/198 |
| 4,850,167 | 7/1989 | Beard et al. | 52/200 |
| 4,854,095 | 8/1989 | Michlovic | 52/468 |
| 4,918,882 | 4/1990 | Funk | 52/86 |
| 5,092,087 | 3/1992 | Kane et al. | 52/15 |

OTHER PUBLICATIONS

"Four Sided Structural Flush Glazing", Super Sky Products, Inc., 1985.

*Primary Examiner*—Carl D. Friedman
*Assistant Examiner*—Kien Nguyen

[57] ABSTRACT

Structural support members are surrounded with a cover that insulates the outer envelope of the support member. The cover may be made of an elastomeric material sufficiently flexible to permit the cover to be physically installed about the structural member. The structural member and cover may also be provided with interlocking means that will retain the cover on the support member once it is installed. Disclosed is a skylight framework formed of a plurality of spaced rafters joined by a plurality of crossbars wherein the rafters and crossbars each include an elongated central support member having a cover member that surrounds the outer envelope of the elongated support member except for a central fastener opening.

11 Claims, 2 Drawing Sheets

FIG. 4
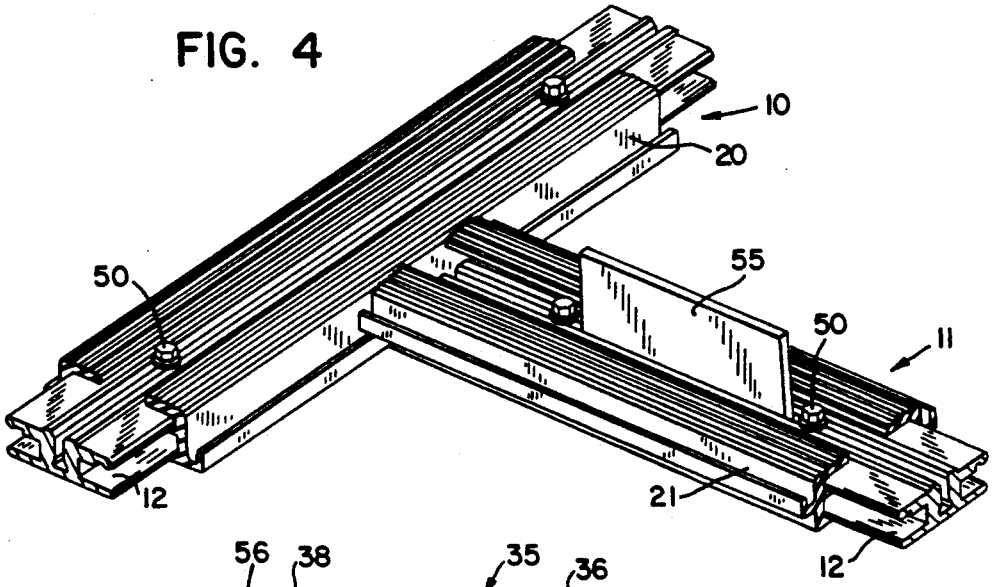
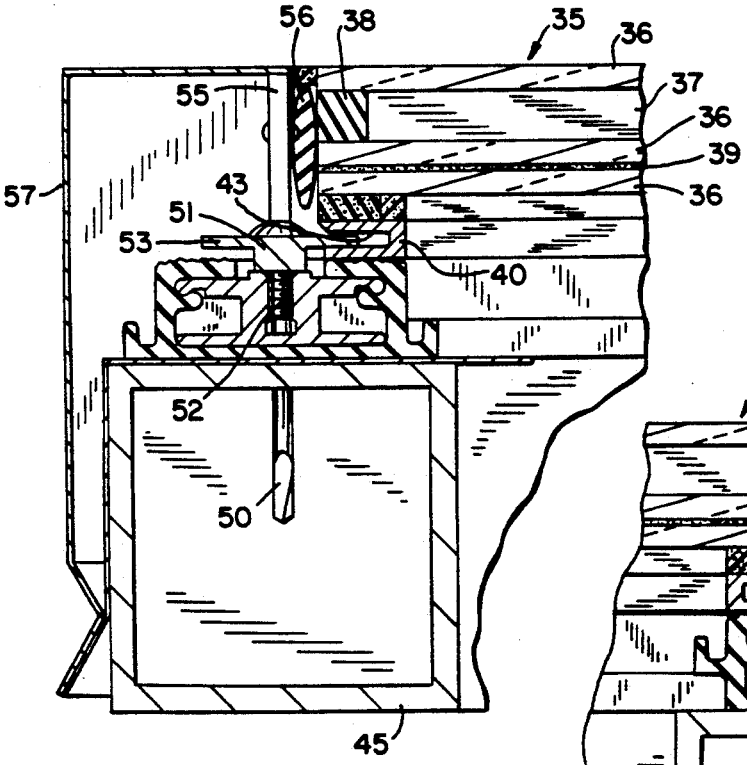
FIG. 3
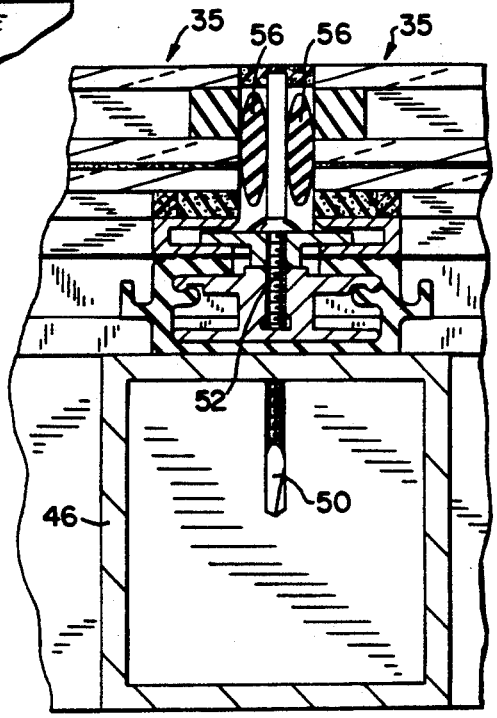
FIG. 2

ENCASED SKYLIGHT FRAMEWORK

BACKGROUND OF THE INVENTION

This invention relates to skylight frameworks, and particularly to a framework of rafters and crossbars that insulates and cushions the framework with respect to the glazing panels that is supports and the structural frame upon which it is mounted.

Frameworks for the glazing panels that form a skylight are typically built up from extruded aluminum rafters and crossbars that are joined together in a variety of ways using threaded fasteners, clips, and the like. The glazing panels are typically pre-assembled in a factory with one or more glazing sheets in a panel and some supporting structure as part of the panel. This allows ease of installation directly to the framework. The framework may provide the necessary structural support for all of the weight and loads on the skylight. However, more typically the framework is itself mounted to a structural frame which may be built up from sections of steel for added strength and durability.

The aluminum framework is subjected to many temperature changes between the exterior and the environment that is enclosed by the skylight. The temperature changes can result in significant condensation of moisture on the surface of the aluminum elements. Heretofore, it has been typical to accommodate condensation by the use of gutters that are extruded into the outer surfaces of the aluminum elements to collect moisture and carry it away. An example of such gutters is shown in U.S. Pat. No. 5,092,087 issued Mar. 3, 1992, and assigned to the assignee of this application.

SUMMARY OF THE INVENTION

It is a principal object of the invention to reduce the problem of temperature and condensation by surrounding structural support members with a cover that insulates the outer envelope of the support member. The insulating cover may also have the property of cushioning the framework both against the structural frame to which it is attached and against the glass panel assemblies which it supports.

Preferably, the cover member is made of an elastomeric material that is sufficiently flexible to permit the cover member to be physically installed about the structural member. The structural member and cover member are preferably provided with interlocking means that will hold the cover member on the support member once it is installed. Such interlocking means may be formed into the support member and the cover member, both of which are preferably extruded. All the extruded elements can be formed to the proper length at the site rather than being required to be fabricated in a factory.

In summary, the invention resides in a skylight framework formed of a plurality of spaced rafters joined by a plurality of crossbars wherein the rafters and crossbars each include an elongated central support member having a base, lateral sides and a top which define an outer envelope, the top including a central fastener opening, and wherein the rafters and crossbars each also have a cover member that surrounds the outer envelope of the support member except for the central fastener opening.

Further in accordance with the invention, a framework of spaced rafters and crossbars between the rafters is formed for mounting skylight panels on a structural frame. The rafters and crossbars each include an elongated central support member having a base, a stem rising from the base, and a pair of lateral arms extending from opposite sides of the stem and spaced from the base. Cover members extend around the outside of the support members. The cover members have a bottom portion that overlays the base and spaced top portions that overlay the lateral arms. The stem of each support member has a central fastener opening for receiving fasteners to connect the rafters and crossbars to the structural frame with the bottom portion of the cover members disposed against the structural frame. The central fastener opening also receives fasteners that join the skylight panels to the rafters and crossbars with the panels disposed against the top portions of the cover members.

Also in accordance with the invention, there are inter-engaging means on the support member and cover members that hold the cover members in place on the support members. Preferably, the inter-engaging means includes an undercut on the underside of each lateral arm adjacent the outer edge of the arm, and a finger projecting inwardly from each side of the cover member. Each member is spaced from a respective top portion of a cover member a distance that is the same as the thickness of a lateral arm and each finger has a protuberance at its end such that a lateral arm is held between a finger and a top portion with the protuberance received in the undercut.

The invention may also include gutters formed integral with the cover members and projecting outwardly from the sides of the cover members. The gutters of the rafters extend outwardly from the bottom portion of the cover member for the rafter, and the gutters of the crossbars are disposed at a level such that they rest upon the gutters of the rafters when a crossbar is in place relative to a rafter.

The foregoing and other objects and advantages of the invention will appear in the following detailed description. In the description, reference is made to the accompanying drawings which illustrate a preferred embodiment of the invention.

BRIEF DESCRIPTION OF THE DRAWINGS

FIG. 2 is an enlarged view in vertical section taken through the plane of the line 2—2 in FIG. 1;

FIG. 3 is a view in vertical section taken in the plane of the line 3—3 in FIG. 1;

FIG. 4 is a view in perspective of a portion of a crossbar in place relative to a section of a rafter;

DETAILED DESCRIPTION OF THE PREFERRED EMBODIMENT

Figure 1:
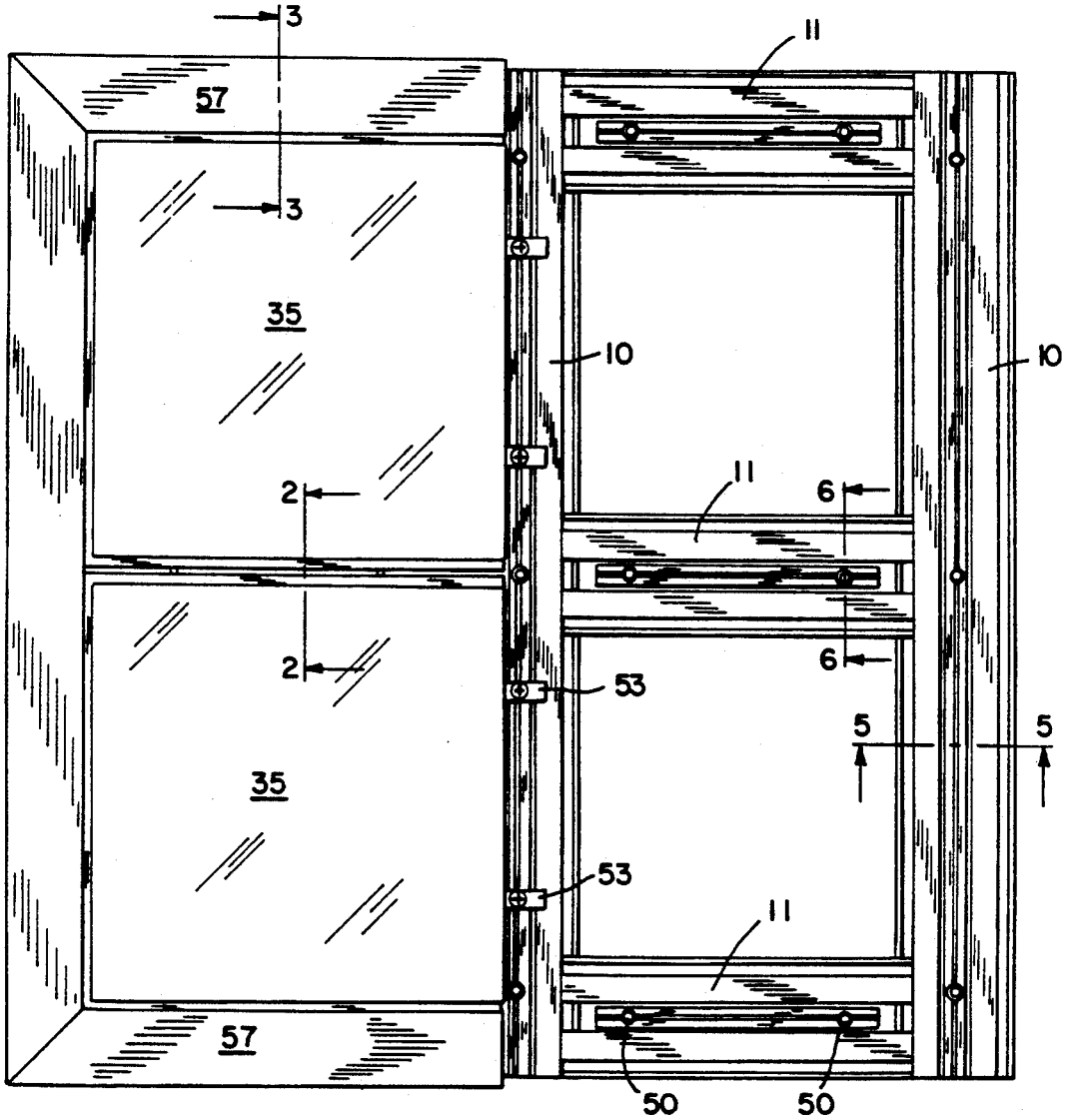
FIG. 1 is a plan view, with portions removed for clarity, of a completed skylight including four glass panel openings.

The skylight framework includes a plurality of rafters identified generally by the numeral 10 that are spaced apart from each other and a plurality of crossbars indicated generally by the numeral 11 that connect between spaced rafters. The rafters 10 and crossbars 11 share a common form of support member indicated generally by the numeral 12 which is formed as an elongated aluminum extrusion. As seen best in FIGS. 5 and 6, the support members 12 are formed with a flat, relatively thin base 13, a central stem portion 14 that rises from the base 13, and laterally extending arms 15 that extend from opposite sides of the stem 14. The arms 15 extend generally parallel with the base 13 and are spaced therefrom. The stem 14 terminates in an upper top surface 17. Extruded into the stem 14 is a fastener groove 18 that opens to the top 17.

Figure 6:
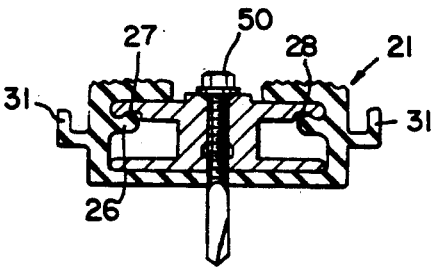
FIG. 6 is a view in vertical section through a crossbar of the framework and taken in the plane of the line 6—6 of FIG. 1.
Figure 5:
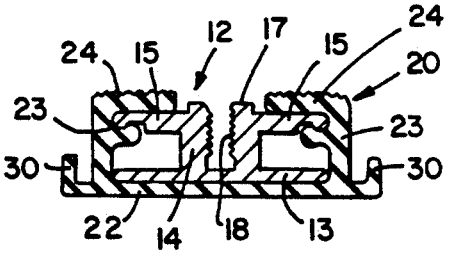
FIG. 5 is a view in vertical section through a rafter of the framework and taken in the plane of the line 5—5 of FIG. 1.

As seen in FIGS. 5 and 6, the extruded elongated support members 12 define a generally rectangular envelope open along its lateral sides. This envelope is surrounded, except at the top surface 17, by a cover member 20 for the rafters and a similar cover member 21 for the crossbars. The cover members 20 and 21 are formed of a material which has thermal insulating properties. The material may also have sound insulating properties and cushioning properties. The material should also be flexible to allow it to be physically placed about the metal support members 12. A natural or synthetic elastomer may have the proper combination of properties. A particular material that has been found useful is an ethylene propylene rubber having a hardness of 75 +5 durometer (Shore A), a minimum tensile strength of 1800 psi and a minimum elongation of 500%.

The covers 20 and 21 each include a bottom portion 22 which overlays the outer surface of the base 13 of a support member 12, a pair of upright lateral side portions 23, and a pair of inwardly extending top portions 24 which overlay the arms 15 of the support member 12. The top portions of the cover members 20 and 21 do not extend across the top surface 17 of the stem 14. As a result, the covers 20 and 21 do not cover the fastening groove 18.

The covers 20 and 21 each have a pair of fingers 26 extending inwardly from the sidewalls 23 and each of the fingers 26 terminates in a protuberance 27. The protuberances 27 are adapted to engage in undercuts 28 formed on the undersides of the arms 15 of the support member 12. As seen in FIGS. 5 and 6 in particular, the fingers 26 are spaced a distance from the top portions 24 of the covers 20 and 21 that is about the same as the thickness of the arms 15. The cover members 20 and 21 are flexible enough so that they can be deformed to extend around the support members 12 during assembly and can be snapped in place. When in place, the cover members 20 and 21 will grip the ends of the arms 15 and hold the cover members in place.

The cover members 20 and 21 are identical except for the location of gutters formed on the outside of the cover members. Specifically, in the cover members 20 for the rafters 10, a gutter 30 is formed integral and projects from either side of the bottom portion of the cover members 20. In the case of the cover members 21 for the crossbars 11, integral gutters 31 are formed that project from the sides 23 of the cover members 21 at a level that is at the top level of the gutters 30.

The rafters 10 and crossbars 11 form a framework that supports a plurality of glazing panels and in turn is supported on a structural frame. The glazing panels 35 are of generally known construction. As can be seen in FIGS. 2 and 3, the glazing panels 35 are made up of a number of sheets of glazing 36, which may be separated by an insulating air layer 37 formed by a spacer 38 which is adhered to the layers of glazing. In FIGS. 2 and 3, the glazing panels 35 are made up of a top layer of glazing 36, an air space 37, and then two lower layers of glazing 36 which are bonded together by an intermediate vinyl layer 39. Attached to the underside of the bottom glazing sheet 36, and a part of the glass panel 35, is a channel 40 which extends around the perimeter of the glazing. The channel 40 is adhered to the glazing by use of an adhesive, preferably a silicone adhesive.

Between the underside of the common glazing sheet 36 and the channel 40 is a glazing gasket 41. Outward from the gasket 41 is a sealant joint 42 which is preferably a silicone sealant that, when applied, serves to seal the joint and to adhere the channel 40 to the bottom layer of glazing 36. The outermost edge of the channel 40 is aligned with the outermost edge of the glazing sheets 36. Each channel 40 has a lateral groove 43. The lateral groove 43 is located on the outer edge of the channel 40 so that the groove 43 extends around the entire perimeter of the glass panel 35. The channels 40 are usually extruded aluminum.

As shown in FIGS. 2 and 3, the rafters 10 and crossbars 11 are mounted on structural frame members 45 and 46, respectively. The frame members 45 and 46 may be box sections of steel tubing welded together at the corners to provide the structural frame. The rafters and crossbars are attached to the structural frame members 45 and 46 by self-drilling fasteners 50 having a hex head and received within the fastener groove 18 in a support member 12.

The glazing panels 35 are held in place on the rafters and crossbars by a plurality of swivel clips 51 which are joined to the top surface 17 of the stems of the support members 12 by round head screws 52. The swivel clips 51 each include a pair of wing portions 53 extending in opposite directions. When the glazing panels are in place, a channel 40 will rest upon one of the top portions 24 of a cover member 20 or 21 with the groove 43 facing towards the swivel clips 51. A swivel clip is rotated to move a wing 53 into the groove 43 to hold the glazing panels in place.

The outer surface of the top portions 24 of the cover members 20 and 21 may be provided with longitudinal grooves and ridges to provide a yielding surface against which the channels 40 can rest and be forced to assure a good seat. The glazing panels 35 are prevented from moving laterally on the framework by upright glass stops 55 which are sections of aluminum plate that are seated within a respective fastener groove 18. Resilient setting blocks 56 are disposed between the ends of glazing panels 35 and the glass stops 55. The openings between the glass stops 55 and the edges of the glazing panels 35 can be filled with a sealant. An aluminum flashing 57 may be mounted at the outer perimeter of the skylight.

The framework has substantially all of the exposed surfaces of the aluminum support members encased in cover members that provide a thermal insulation to the aluminum support members. As a result, the framework, which is the interface between the glazing panels exposed to the exterior and the interior support frame, will not collect condensation as does the typical aluminum skylight frame. The cover members also provide a sound insulation as well as thermal insulation and because they are more flexible than a metallic material, also provide a cushioning of the glazing panels to the steel structural frame.

As seen in FIG. 4, the gutters on the crossbars rest upon and lead directly into the gutters on the rafters. The gutters are not needed to collect condensation from the framework. They are present in case the skylight develops leaks. The aluminum support members 12 of the crossbars 11 are cut to a length that is less than the cover members 21 for the crossbars, as shown in FIG. 4, so that the support members do not interfere with the sides of the rafters. All of the rafters and crossbars can be cut to length and assembled on the construction site from length of extrusions of the support members and cover members.

I claim:

1. A skylight framework, comprising:

a plurality of spaced rafters joined by a plurality of crossbars, the rafters and crossbars each including an elongated central support member having a base, lateral sides, and a top which together define an outer envelope, the top having a central fastener opening, the rafters and crossbars each also having a separate cover member that surrounds the outer envelope of the support member except for the central fastener opening.

2. A framework in accordance with claim 1 wherein the support members and cover members have interlocking means to hold a cover member on a support member.

3. A framework in accordance with claim 1 wherein the cover members are formed of an elastomer.

4. A framework in accordance with claim 1 wherein the support members are metallic and the cover members are formed of an insulating material.

5. A framework in accordance with claim 4 wherein the support members and cover members are cut from extruded lengths of material.

6. A framework for mounting skylight panels on a structural frame, comprising:

a plurality of spaced rafters and a plurality of crossbars between rafters, the rafters and cross bars each including an elongated central support member having a base, a stem rising from the base, and a pair of lateral arms extending from opposite sides of the stem and spaced from the base, the rafter and crossbar each also including a cover member that extends around the outside of the support member, the cover member having a bottom portion that overlays the base and spaced top portions that overlay the arms, the stem of each support member having a central fastener opening for receiving fasteners to connect the rafters and crossbars to the structural frame with the bottom portions of the cover members disposed against the structural frame and for receiving fasteners to join the skylight panels to the rafters and crossbars with the panels disposed against the top portions of the cover members.

7. A framework in accordance with claim 6 wherein the cover members are formed of an insulating material.

8. A framework in accordance with claim 6 wherein the cover members and the lateral arms of the support members have inter-engaging means to hold the cover members onto the support members.

9. A framework in accordance with claim 8 wherein the cover members are formed of a flexible elastomeric material.

10. A framework in accordance with claim 9 wherein the inter-engaging means comprises an undercut on the underside of each lateral arm adjacent the outer edge of the arm, and a finger projecting inwardly from each side of the cover member, each finger being spaced from a respective top portion a distance that is the same as the thickness of a lateral arm and each finger having a protuberance at its end, whereby each lateral arm is held between a finger and a top portion with the protuberance received in the undercut.

11. A framework in accordance with claim 6 wherein the cover members each include integral gutters projecting outwardly from their sides, the gutters of the rafters extending outwardly from the bottom portion of the cover member for the rafter and the gutters of the crossbars being disposed at a level that they rest upon the gutters of the rafters.

* * * * *